US009423760B2

(12) United States Patent
Kakitani et al.

(10) Patent No.: US 9,423,760 B2
(45) Date of Patent: Aug. 23, 2016

(54) DEVELOPER ACCOMMODATING CONTAINER AND IMAGE FORMING APPARATUS

(71) Applicant: CANON KABUSHIKI KAISHA, Tokyo (JP)

(72) Inventors: Masaki Kakitani, Abiko (JP); Koichi Taniguchi, Tokyo (JP); Tadashi Iwakawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/924,820

(22) Filed: Jun. 24, 2013

(65) Prior Publication Data

US 2014/0016977 A1 Jan. 16, 2014

(30) Foreign Application Priority Data

Jul. 10, 2012 (JP) ..... 2012-154360

(51) Int. Cl.
*G03G 21/12* (2006.01)
*G03G 21/10* (2006.01)

(52) U.S. Cl.
CPC ..... *G03G 21/12* (2013.01); *G03G 21/105* (2013.01); *G03G 2215/0129* (2013.01)

(58) Field of Classification Search
CPC ..... G03G 21/105; G03G 21/12; G03G 2221/1624
USPC ..... 399/35, 358, 360
See application file for complete search history.

(56) References Cited

U.S. PATENT DOCUMENTS 3,635,373 A * 1/1972 Kuhl et al.
3,682,132 A * 8/1972 Kamola
3,727,065 A * 4/1973 Maksymiak
3,756,192 A * 9/1973 Locklar et al.
3,757,999 A * 9/1973 Maksymiak
3,777,173 A * 12/1973 Landrith (Continued)

FOREIGN PATENT DOCUMENTS

JP H04-55882 A 2/1992
JP 2000075749 A 3/2000

(Continued)

OTHER PUBLICATIONS

Office Action in Japanese Patent Application No. 2012-154360, dated May 10, 2016.

*Primary Examiner* — Walter L Lindsay, Jr.
*Assistant Examiner* — Milton Gonzalez
(74) *Attorney, Agent, or Firm* — Fitzpatrick, Cella, Harper & Scinto

(57) ABSTRACT

A developer accommodating container, comprising: an accommodating portion provided with a falling inlet; an optical portion which forms a light path inside the accommodating portion; a space portion which is provided in the middle of the light path and capable of accumulating the developer accommodated in the accommodating portion; a casing portion which has a cover portion covering the space portion not to flow in the developer to the space portion except a surface of the opposite side which is formed the falling inlet seeing from the space portion, and that has a introducing inlet which can introduce the developer to the space portion from upper position than at least a bottom of the space portion, and that has a discharge outlet which can discharge the developer at a lower position than the space portion.

20 Claims, 10 Drawing Sheets

(56) References Cited

U.S. PATENT DOCUMENTS

| | | | | |
|---|---|---|---|---|
| 3,791,744 | A | * | 2/1974 | Erny et al. |
| 3,872,824 | A | * | 3/1975 | Erny et al. |
| 4,131,081 | A | * | 12/1978 | Terashima |
| 4,166,702 | A | * | 9/1979 | Okamoto et al. |
| 4,208,985 | A | * | 6/1980 | Anzai et al. |
| 4,240,375 | A | * | 12/1980 | Terashima |
| 4,292,925 | A | * | 10/1981 | Terashima |
| 4,331,184 | A | * | 5/1982 | Terashima et al. |
| 4,342,283 | A | * | 8/1982 | Terashima |
| 4,346,985 | A | * | 8/1982 | Watson et al. |
| 4,369,733 | A | * | 1/1983 | Hirakura et al. |
| 4,389,972 | A | * | 6/1983 | Hirakura et al. |
| 5,329,340 | A | * | 7/1994 | Fukuchi et al. |
| 7,072,601 | B2 | | 7/2006 | Kakitani et al. |
| 7,483,646 | B2 | | 1/2009 | Ueno et al. |
| 7,630,665 | B2 | | 12/2009 | Ueno et al. |
| 7,778,570 | B2 | | 8/2010 | Numagami et al. |
| 8,150,293 | B2 | | 4/2012 | Numagami et al. |
| 8,213,828 | B2 | | 7/2012 | Murayama et al. |
| 8,417,144 | B2 | | 4/2013 | Numagami et al. |
| 2012/0121278 | A1 | | 5/2012 | Kitagawa |
| 2012/0177403 | A1 | | 7/2012 | Murayama et al. |

FOREIGN PATENT DOCUMENTS

| | | | | |
|---|---|---|---|---|
| JP | 2002328522 | A | | 11/2002 |
| JP | 2006-098646 | A | | 4/2006 |
| JP | 3919465 | B2 | | 5/2007 |
| JP | 2007212656 | A | * | 8/2007 |
| JP | 2008051860 | A | | 3/2008 |
| JP | 2008299153 | A | | 12/2008 |
| JP | 2010134385 | A | | 6/2010 |
| JP | 2011-248131 | A | | 12/2011 |
| JP | 2012-103569 | A | | 5/2012 |

* cited by examiner

DEVELOPER ACCOMMODATING CONTAINER AND IMAGE FORMING APPARATUS

BACKGROUND OF THE INVENTION

1. Field of the Invention

The present invention relates to a developer accommodating container which includes a detecting mechanism that detects the amount of powders within an accommodating container for accommodating powders and an image forming apparatus provided with the developer accommodating container.

2. Description of the Related Art

In an image forming apparatus having an intermediate transfer belt, a toner image formed on a photosensitive drum is transferred to the intermediate transfer belt and the toner image transferred to the intermediate transfer belt is transferred to a recording material. Then, transfer residual toner remaining on the surface of the photosensitive drum or the intermediate transfer belt is collected by a cleaning member and is collected in an accommodating container via a conveying path through which the collected toner is conveyed.

When a predetermined amount of toner is accumulated in the accommodating container, it is necessary to replace the accommodating container. In order to facilitate the replacement of the accommodating container, then, it is necessary to prepare a toner detecting apparatus that determines whether the toner reaches a predetermined amount. The invention relative to such toner detecting apparatus is disclosed in Japanese Patent Laid-Open No. 2000-75749.

In Japanese Patent Laid-Open No. 2000-75749, a light emitting element and a light receiving element are provided at one side of a transparent accommodating container and a prism is provided at the other side thereof. Moreover, the invention related to a toner amount detecting apparatus is disclosed which detects whether the toner within the accommodating container reaches a predetermined amount because light of the light emitting element is blocked out in the toner and thus is not detected by the light receiving element.

However, according to the invention disclosed in Japanese Patent Laid-Open No. 2000-75749, although the cost is inexpensive, scattered toner is attached on the surface of an inner wall of the accommodating container at which the prism is installed and, accordingly, there is a possibility to erroneously detect that the toner reaches the predetermined amount before the toner reaches the predetermined amount.

SUMMARY OF THE INVENTION

In view of the above-described problems, it is desirable to provide a developer accommodating container which can reliably detect the amount of powders within an accommodating container without an erroneous detection compared to the related art.

A developer accommodating container, comprising:

an accommodating portion provided with a falling inlet which receives a falling developer;

an optical portion which forms a light path inside the accommodating portion;

a space portion which is provided in the middle of the light path formed by the optical portion and capable of accumulating the developer accommodated in the accommodating portion;

a casing portion which has a cover portion covering the space portion not to flow in the developer to the space portion except a surface of the opposite side which is formed the falling inlet seeing from the space portion, and that has a introducing inlet which can introduce the developer to the space portion from upper position than at least a bottom of the space portion, and that has a discharge outlet which can discharge the developer which is introduced from the introducing inlet at a lower position than the space portion.

Further features of the present invention will become apparent from the following description of exemplary embodiments with reference to the attached drawings.

DESCRIPTION OF THE EMBODIMENTS

Hereinafter, exemplary embodiments of the invention will be described in detail with reference to appended drawings. However, dimensions, materials, shapes, and relative positions of components described in the following embodiments are appropriately modified according to structures or various conditions of an apparatus to which the invention is applied. Therefore, the scope of the invention, unless otherwise specified in particular, is not intended to limit thereto.

Figure 1:
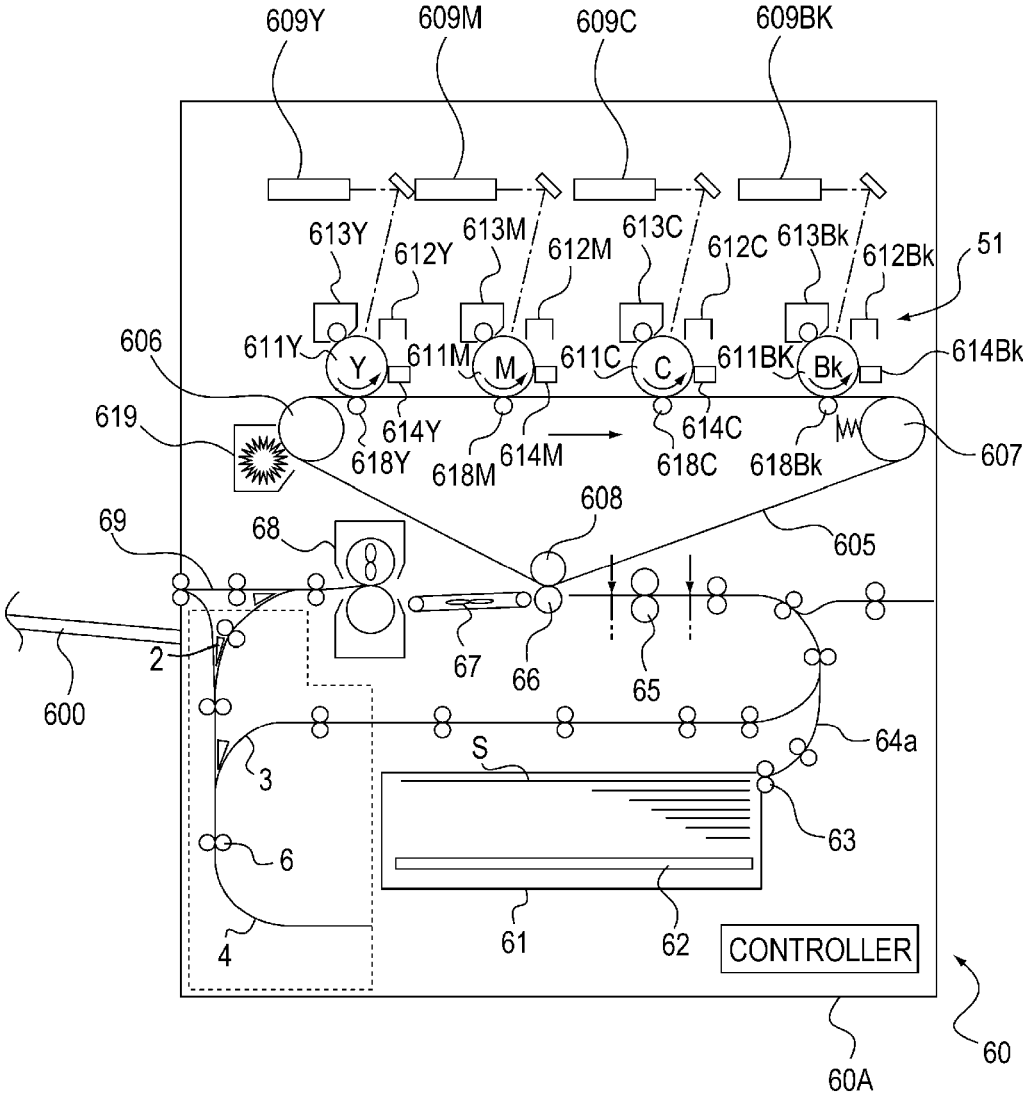
FIG. 1 is a sectional view illustrating a structure of an image forming apparatus provided with a powder amount detecting system according to an embodiment of the invention.

FIG. 1 is a sectional view illustrating a structure of an image forming apparatus 60 provided with a powder amount detecting system 100 (see FIG. 5) according to an embodiment of the invention. The image forming apparatus 60 is an image forming apparatus using an electrophotographic image forming process. As illustrated in FIG. 1, the image forming apparatus 60 includes an image forming apparatus body (hereinafter, simply referred to as an "apparatus body") 60A, and an image forming portion 51 is provided in the apparatus body 60A to form an image. The image forming portion 51 includes a photosensitive drum 611 which is an "image bearing member" and a primary transfer roller 618 which is a "transfer apparatus". For at least the photosensitive drum 611, it is contained in a process cartridge and may be configured to be incorporated in the apparatus body 60A as the process cartridge. The image forming apparatus 60 is an image forming apparatus of a so-called intermediate transfer tandem type in which the image forming portions of four colors are juxtaposed on an intermediate transfer belt 605 and has become a mainstream in recent year because of its superiority in terms of the compatibility with thick sheet or productivity.

A recording material S is stored in the form of being stacked on a lift-up apparatus 62 within a recording material storage case 61. Further, the recording material S is fed according to an image forming timing by a pair of feed rollers 63. Here, the pair of feed rollers 63 employs a system using a frictional separation by a separation roller. The recording material S fed out by the pair of feed rollers 63 passes through a conveying path 64*a* and is conveyed into a registration roller 65.

The registration roller 65, which is an apparatus for adjusting a relative position of the recording material S and the image, is fed out a secondary transfer portion after performing a skew correction or a timing correction of the recording material S. The secondary transfer portion is a toner image transferring nip portion for transferring a toner image to the recording material S which is formed by a secondary transfer inner roller 608 and a secondary transfer outer roller 66 facing each other and causes the toner image to adhere onto the recording material S by applying a predetermined pressured force and an electrostatic load bias.

The process of forming an image fed to the secondary transfer portion at the same timing as the process of conveying the recording material S to the secondary transfer portion as described above will be described. The image forming portion 51 mainly includes the photosensitive drum 611, a charging apparatus 612, an exposure apparatus 609, a developing apparatus 613, the primary transfer roller 618, and a photosensitive cleaner 614.

An electrostatic image is formed on the photosensitive drum 611 of which the surface is uniformly charged in advance by the charging apparatus 612 to rotate in the direction of the arrow D, appropriately through a diffraction unit 610, by driving the exposure apparatus 609 based on a transmitted signal of image information. The electrostatic image formed on the photosensitive drum 611 is visualized as a toner image on the photosensitive drum 611 through toner development by the developing apparatus 613. Subsequently, the toner image is transferred onto an intermediate transfer belt 605 by applying a predetermined pressured force and an electrostatic load bias by the primary transfer roller 618.

Moreover, the above-described image forming portion 51 is made up of four sets of yellow (Y), magenta (M), cyan (C) and black (Bk).

Next, the intermediate transfer belt 605 will be described. The intermediate transfer belt 605 is stretched by rollers such as a drive roller 606, a tension roller 607 and the secondary transfer inner roller 608 and is driven in a direction of the arrow B. The image forming processes of the respective colors to be processed in parallel by each image forming mechanism of the above-described Y, M, C and Bk are performed at timing as being superimposed on the toner image of an upstream color primarily transferred onto the intermediate transfer belt 605. Consequently, the toner image of full color is finally formed on the intermediate transfer belt 605 and is conveyed to the secondary transfer portion.

The toner image of full color is secondarily transferred onto the recording material S at the secondary transfer portion with the conveying process of the recording material S and the image forming process, which are described above, respectively. Here also, the transfer residual toner remaining slightly on the intermediate transfer belt 605 is collected by a cleaning apparatus 619 of the intermediate transfer belt 605, in the same manner, and is conveyed by a conveying path 21 (see FIG. 2), resulting in falling into an accommodating container (accommodating portion) 11 (see FIG. 2) and being stored therein.

Subsequently, the recording material S is conveyed to a fixing apparatus 68 by a pre-fixing conveying portion 67. The fixing apparatus 68 melts and fixes the toner image on the recording material S with the predetermined pressed force due to opposed rollers or belts in addition to heating effect due to a heat source such as a heater. Path selection is performed such that the recording material S having the fixed image obtained as described above is conveyed to either a discharge conveying path 69 for directly discharging onto a discharge tray 600 or to a reverse guide path 2 included in a reverse conveying apparatus 10 when an duplex image forming is required. In a case of requiring the duplex image forming, the recording material S is drawn to a switch-back path 4 from the reverse guide path 2 and then is conveyed again to the image forming portion 51 through a duplex conveying path 3 by forwarding and reversing the rotational direction (i.e., switch-back operation) of a reverse roller 6 to switch front-rear ends of the recording material S.

Figure 2:
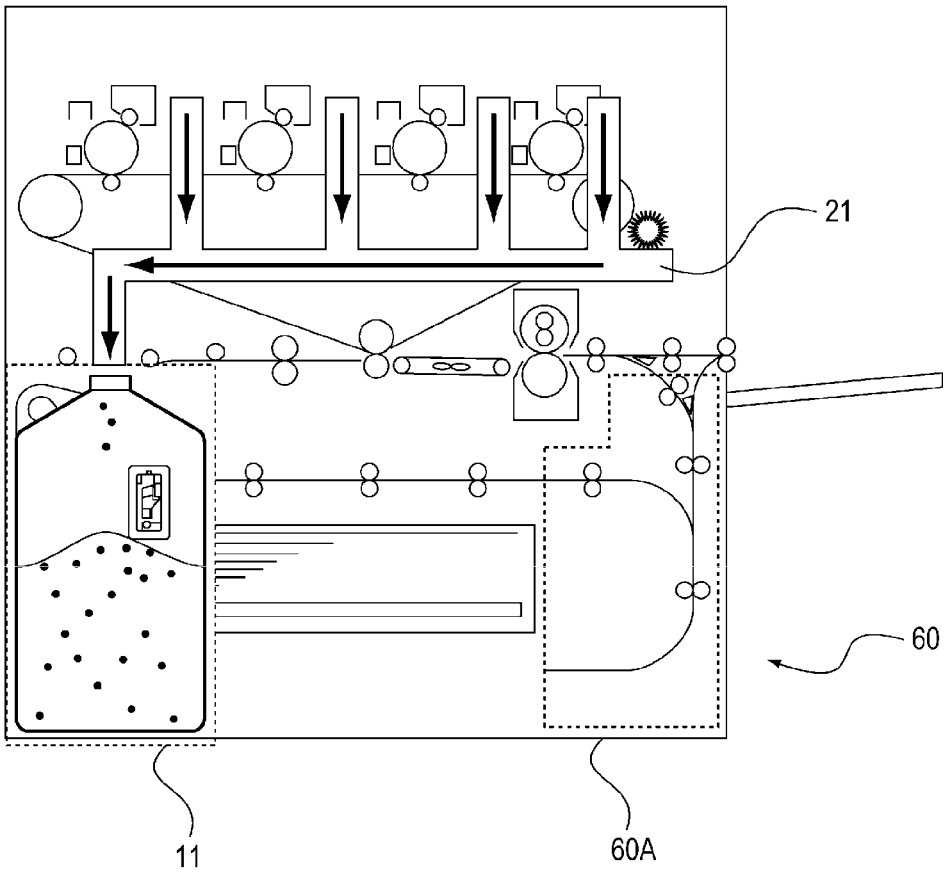
FIG. 2 is a sectional view of the image forming apparatus taken along another position.

FIG. 2 is a sectional view of the image forming apparatus 60 taken along another position. As illustrated in FIG. 2, the apparatus body 60A is provided with the accommodating container (powder storing container) 11 for accommodating toner T (developer) and the conveying path 21 for conveying the collected toner, which are disposed therein, respectively. The transfer residual toner remaining slightly on the above-described photosensitive drum 611 is collected by the photosensitive cleaner 614 to prepare for a next image forming again. Here, the collected transfer residual toner is conveyed by the conveying path 21 and then falls into the accommodating container 11 to be stored therein.

As illustrated in FIG. 2, the accommodating container 11 is disposed at the left back side of the apparatus body 60A. The conveying path 21 is provided in the apparatus body 60A to convey the transfer residual toner on the intermediate transfer belt 605 or the transfer residual toner remaining on the photosensitive drum 611. These residual toners, as described above, are conveyed to the accommodating container 11 by the conveying path 21 and the toners collected in the accommodating container 11 are accumulated.

Figure 3:
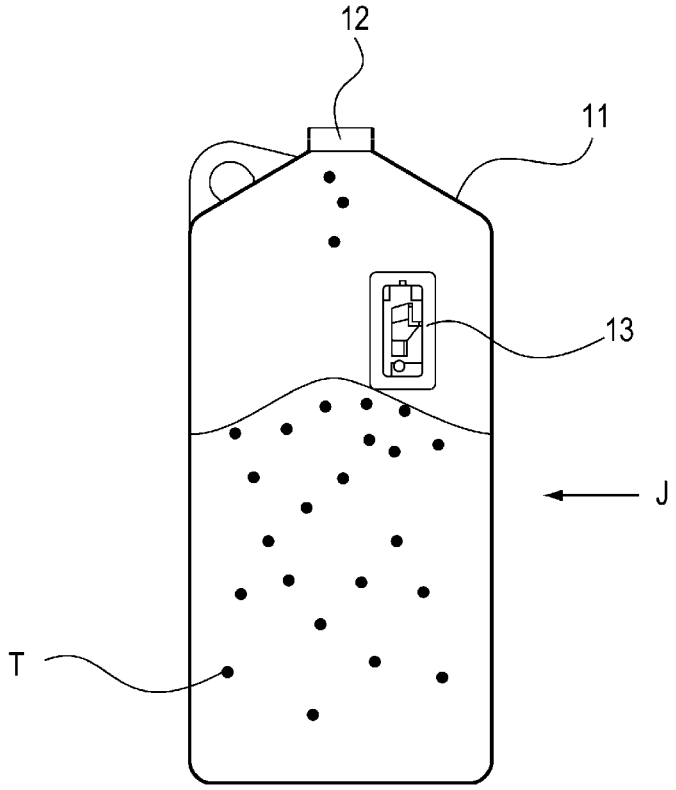
FIG. 3 is a sectional view illustrating a structure of an accommodating container.

FIG. 3 is a sectional view illustrating a structure of the accommodating container 11. The accommodating container 11 illustrated in FIG. 3 includes a falling inlet 12 (receiving inlet) to which "powder" toner T falls to accommodate the falling toner T. A prism unit 13 is disposed at a position, which is closer to the right from the falling inlet 12 at a lateral face of the accommodating container 11, to refract light emitted from a reflective sensor 17 (see FIG. 4). That is, an introducing portion 23 of the prism unit 13, which will be described below, is disposed outside the projecting region of the falling inlet 12 in the gravity direction thereof.

Figure 4:
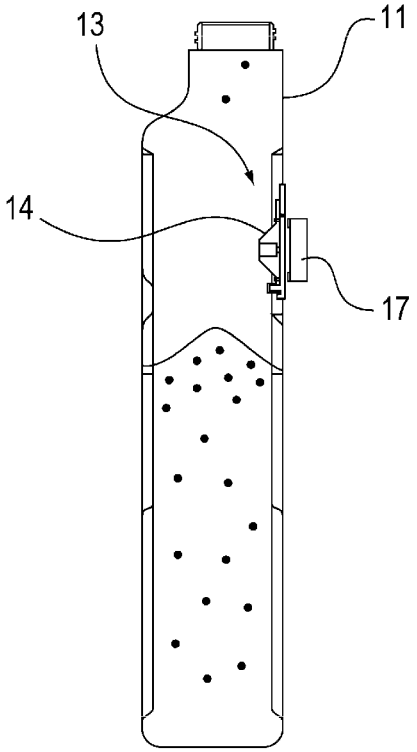
FIG. 4 is a sectional view as seen from a direction indicated by the arrow J in FIG. 3.

FIG. 4 is a sectional view as seen from a direction indicated by the arrow J in FIG. 3. In FIG. 4, however, the reflective sensor 17 is additionally provided compared to FIG. 3. As illustrated in FIG. 4, the prism unit 13 is installed to enter inside a lateral face of the accommodating container 11. Accordingly, since the prism unit 13 is installed so as not to protrude from an outer peripheral of the accommodating container 11, it does not become an obstacle when the accommodating container 11 is set in the apparatus body 60A.

The reflective sensor 17 is disposed at the apparatus body 60A side. Therefore, when the accommodating container 11 is disposed at a predetermined position of the apparatus body 60A, the reflective sensor 17 is disposed at a position which is opposite to the prism unit 13. The reflective sensor 17 may also be directly installed in the accommodating container 11. However, since the accommodating container 11 is a regular replacement component, resulting in a damage of replacement property or an increase in a running cost, this embodiment is configured such that the reflective sensor 17 is retained in the apparatus body 60A side.

Figure 5:
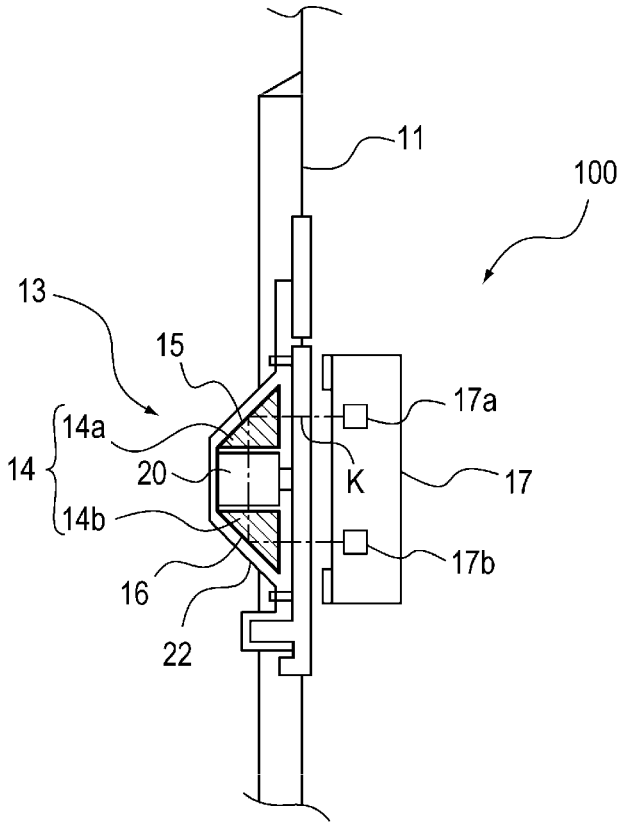
FIG. 5 is a sectional view illustrating a structure of a powder amount detecting system.

FIG. 5 is a sectional view illustrating a structure of the powder amount detecting system 100. The powder amount detecting system 100 illustrated in FIG. 5 is provided with the prism unit 13 and the reflective sensor 17. The prism unit 13 is detachably attachable to the accommodating container 11 and can easily be replaced and cleaned. The prism unit 13 is provided with a prism (prism portion) 14, a covering member (casing portion) 22, and an introducing member (guide portion) 23 (see FIG. 6). In this embodiment, furthermore, the structure having the accommodating container 11 and the prism unit 13 is referred to as a "developer accommodating container".

First, the reflective sensor 17 serving as a "detecting unit" includes a light emitting element 17*a* which emits light and a light receiving element 17*b* which receives the light emitted from the light emitting element 17*a*. In addition, the reflective sensor 17 detects that the toner T within the accommodating container 11 is filled with a predetermined amount when a light path K from the light emitting element 17*a* to the light receiving element 17*b* is light-blocked by the toner T. Here, the reflective sensor 17 is disposed outside the accommodating container 11. It will be described below where the toner T blocks out the light.

Next, the prism unit 13 includes a prism 14 inside the accommodating container 11. The prism 14 is a member which is disposed inside the accommodating container 11 to define the light path K of the light. The prism 14 includes a first prism 14*a* (a first optical portion) and a second prism 14*b* (a second optical portion) having a reflective surface for reflecting the light in the middle of the light path K. The first prism 14*a* and the second prism 14*b* are arranged in a vertical direction. That is, the first prism 14*a* is disposed at an upper side and the second prism 14*b* is disposed at a lower side. The first prism 14*a* has a first reflective surface 15 which is an inclined surface in FIG. 5 for reflecting the light and the second prism 14*b* has a second reflective surface 16 which is an inclined surface in FIG. 5 for reflecting the light.

The first reflective surface 15, the second reflective surface 16, and the reflective sensor 17 are disposed so that the light emitted from the light emitting element 17*a* of the reflective sensor 17 is bent downward in a substantially vertical direction at the first reflective surface 15 and additionally bent to the light receiving element 17*b* of the reflective sensor 17 at the second reflective surface 16.

A detecting region 20 (space portion) (accumulating space) which is an "accumulating space" is defined inside the accommodating container 11 and is a space that is defined to be capable of accumulating the toner T in the middle of the light path K. Particularly, the detecting region 20 is defined between the first prism 14*a* and the second prism 14*b*. The toner T is introduced to the detecting region 20 and then is accumulated therein by the introducing member 23 (see FIG. 6) which will be described later. It is configured to detect the presence of the toner T by closing the light path with the toner T which is flowed into the detecting region 20.

The covering member 22 is disposed inside the accommodating container 11. The covering member 22, which is a "covering unit", is a member that covers the prism 14 to cover the prism 14 from the toner T. For this reason, the covering member 22 is a member that covers the detecting region 20 at a region other than an introducing region of the introducing member 23.

Figure 6:
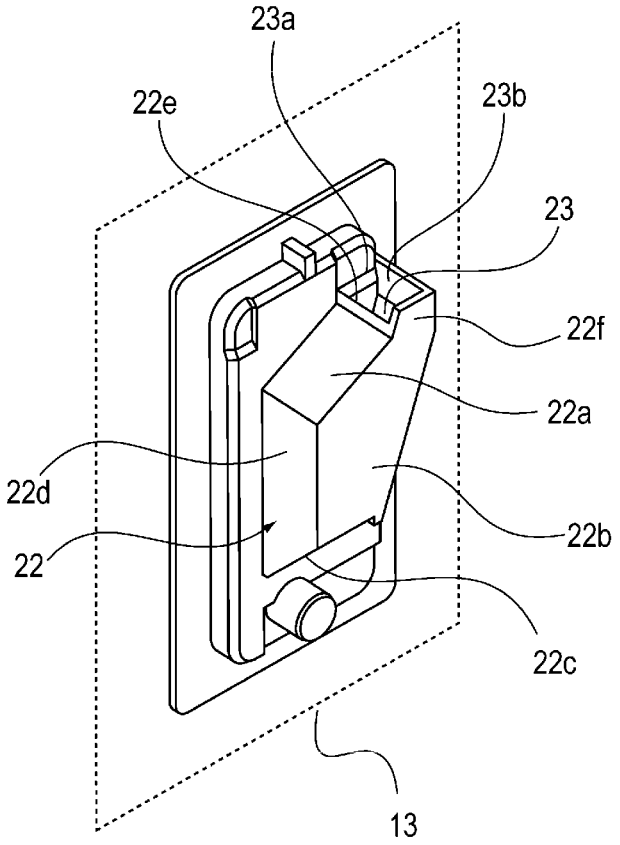
FIG. 6 is a perspective view illustrating a structure of a blocking member disposed inside the accommodating container.

FIG. 6 is a perspective view illustrating a structure of the covering member 22 disposed in the accommodating container 11. As illustrated in FIG. 6, the prism unit 13 includes the covering member 22 which covers the prism 14 (see FIG. 7) in the prism unit 13. By the covering member 22, it is possible to prevent the toner T fallen from the falling inlet 12 from entering the detecting region 20 (see FIG. 7) defined in the prism 14 without passing through the introducing member 23.

In addition, the covering member 22 includes a first face 22*a* (inclined portion) which is inclined at a top face portion so as to descend to the falling inlet 12 side. That is, the first face 22*a* forms the top face of the covering member 22. Further, the covering member 22 includes a front face portion 22*b* extending in a vertical direction, a second face 22*c* inclined so as to ascend, and a lateral face portion 22*d*. Here, the lateral face portion 22*d* is a lateral face (a first lateral face) provided at the falling inlet 12 side of the accommodating container in the lateral face portion of the covering member 22. In addition, the front face portion 22*b* and a lateral face opposite to the front face portion 22*b* are a pair of lateral faces (a second lateral face) which is adjacent to the lateral face portion 22*d* to form a lateral face of the covering member 22. Further, a face opposite to the lateral face portion 22*d* in the lateral face portion of the covering member 22 is provided with the introducing member 23 (a third lateral face portion) to form a casing portion for covering a circumference of the prism 14. In addition, a rib 22*e* is provided at an introducing inlet 23*a* (opening portion) side of the first face 22*a*. Although the toner T is scattered inside the accommodating container 11, the toner T is blocked out by the first face 22*a*, the front face portion 22*b*, the second face 22*c*, the lateral face portion 22*d*, and the rib 22*e*, thereby not reaching the detecting region 20.

Before the toner T enters the detecting region 20 of the prism 14, the scattering toner descends and accumulates on the covering member 22 (blocking member). After a certain amount of the scattered and deposited toner T is accumulated, it is concerned that the toner T falls to the introducing member 23 from the introducing inlet 23*a* and flows into the detecting region. In this case, although the toner T is not accumulated to an assumed amount within the accommodating container 11, fullness is early detected. In order to prevent these, the first face 22*a* is inclined to the falling inlet 12 side. The first face 22*a* prevents the scattering toner poured into the covering member 22 from being fallen to the introducing member 23. In addition, the rib 22*e* further prevents from falling into the introducing member 23.

Further, in the configuration of the embodiment, since the introducing member 23 is configured with an inclined face of a repose angle or more of the powder, the toner T reliably slides down on the introducing member 23. It is configured to reliably introduce the toner T to the detecting region 20 by using a momentum of the sliding down.

However, in case where the toner T enters a circumference of the lowest point 25 (see FIG. 7) of the introducing member 23 without passing through the introducing member 23, since the toner T does not have the above-described momentum of the sliding down, it does not flow into the detecting region 20. As a result, the toner T is gradually deposited on the fallen position (for example, the lowest point 25 of the introducing member 23) to become a wall, and thus the toner T flowing subsequently through the introducing member 23 does not reach the detecting region 20. In this way, even when the accommodating container 11 becomes full, the toner T does not enter the detecting region 20, and thus it is concerned that the light is not blocked out to generate a mechanical failure without detecting the fullness.

Therefore, the covering member 22 is configured such that an upper part 22*f* of the front face portion is equal to or higher than the uppermost point of the first face 22*a* or the rib 22*e* so as to prevent an inflow of the toner into the detecting region 20 from the front face portion 22*b*. As a result, the toner T accumulated in the accommodating container 11 falls into the introducing member 23 beyond the rib 22*e* from the first face 22*a* rather than from the front face portion 22*b*. As illustrated in FIG. 3, when a certain amount of the toner is accumulated by being deposited in a heap which has the falling inlet 12 at the top inside the accommodating container 11, the skirts of the heap formed at the repose angle of the toner T is deposited up to the first face 22*a* and the rib 22*e*. When the toner T is further deposited, the heap of the deposited toner swiftly collapses to collide with the wall 23*b* provided in the introducing member 23 and then slides down the introducing member 23. As a result, the toner slides down the inclined face and can certainly reach the detecting region 20.

As described above, the prism unit 13 includes the introducing member 23. The introducing member 23 is disposed toward a lateral face of the accommodating container 11 rather than the falling inlet 12 (see FIG. 6) and a member for introducing the toner T to the detecting region 20 inside the covering member 22. In addition, the introducing member 23 may be referred to as a member for forming a part of the introducing inlet 23*a* which introduces the toner T with respect to the light path K (see FIG. 5) formed by the prism 14.

Figure 7:
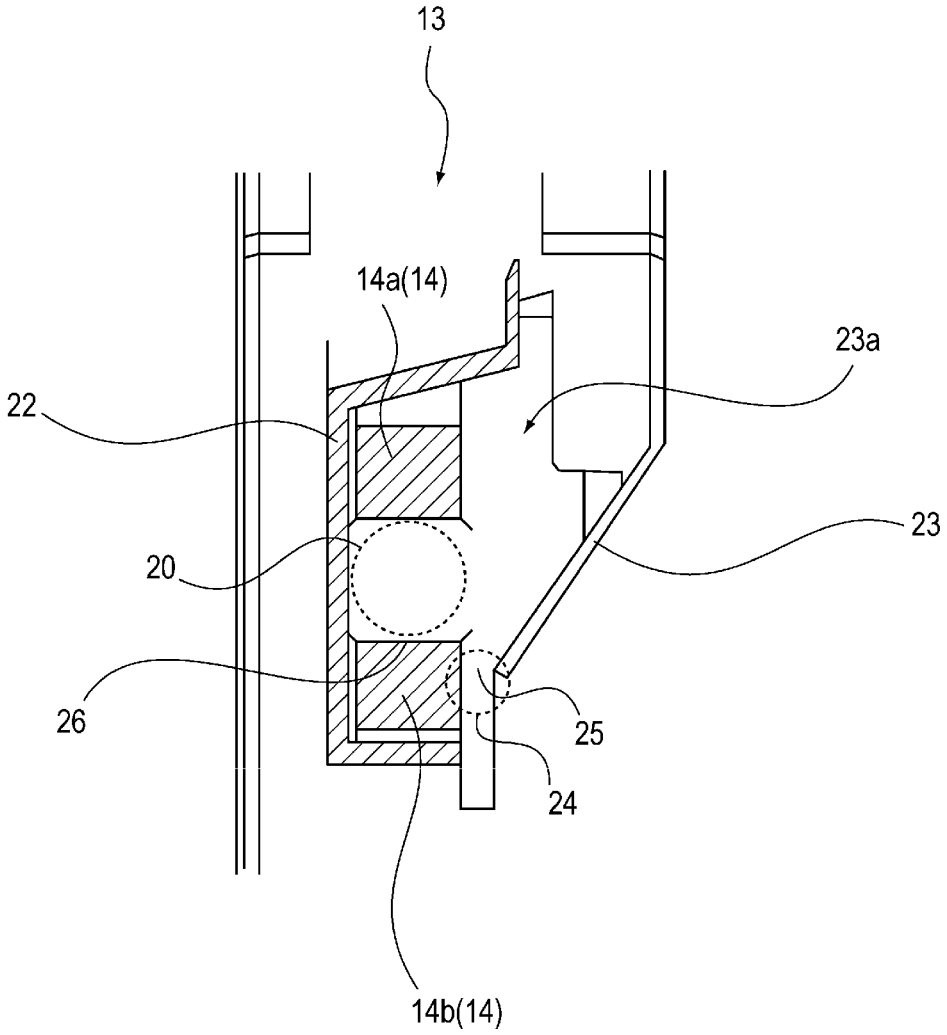
FIG. 7 is a sectional view illustrating a structure of a prism unit.

FIG. 7 is a sectional view illustrating a structure of the prism unit 13. As described above, the prism 14 on the falling inlet 12 is covered by the covering member 22 to prevent the collected toner from entering the detecting region 20.

Meanwhile, the prism unit 13 is provided with the introducing member 23 which is disposed toward the lateral face of the accommodating container 11 rather than the covering member 22 when viewed from the falling inlet 12 in the accommodating container 11 to introduce the toner T to the detecting region 20 when a predetermined amount of the toner T is deposited in the accommodating container 11. By providing the introducing member 23, it is possible to prevent the toner T from going on being deposited without entering the detecting region 20 due to a bridge caused by the toner T deposited in the vicinity of the detecting region.

As illustrated in FIG. 7, in the prism unit 13, the introducing inlet 23*a* of the introducing member 23 as a portion thereof is open and other portions are covered by the covering member 22. Therefore, in order to detect the light at the light path K of the prism 14, a portion for accumulating the toner T introduced through the introducing member 23 is required inside the covering member 22.

Here, the detecting region 20 is defined between the first prism 14*a* and the second prism 14*b*, which are included in the prism 14, to accumulate the toner T. Further, since the toner T accumulated in the detecting region 20 closes the light path K and thus the light does not come back to the light receiving element 17*b* of the reflective sensor 17, it is detected that the toner T has reached a predetermined amount.

According to the configuration of the embodiment, the amount of the toner T within the accommodating container 11 is more reliably detected without being erroneously detected than ever before. Since the covering member 22 covers the detecting region 20, a phenomenon in which the scattering toner T invades into the detecting region 20 from the regions other than the introducing region is suppressed. Since the toner T is introduced to the detecting region 20 through the introducing member 23, the toner T accumulated in the accommodating container 11 is introduced to the detecting region 20.

In this embodiment, since a top face (detecting region surface 26) of the second prism 14*b* included in the prism 14 also serves as a portion for accumulating the toner T, there is no need to separately provide a member to accumulate the toner T.

Figure 9:
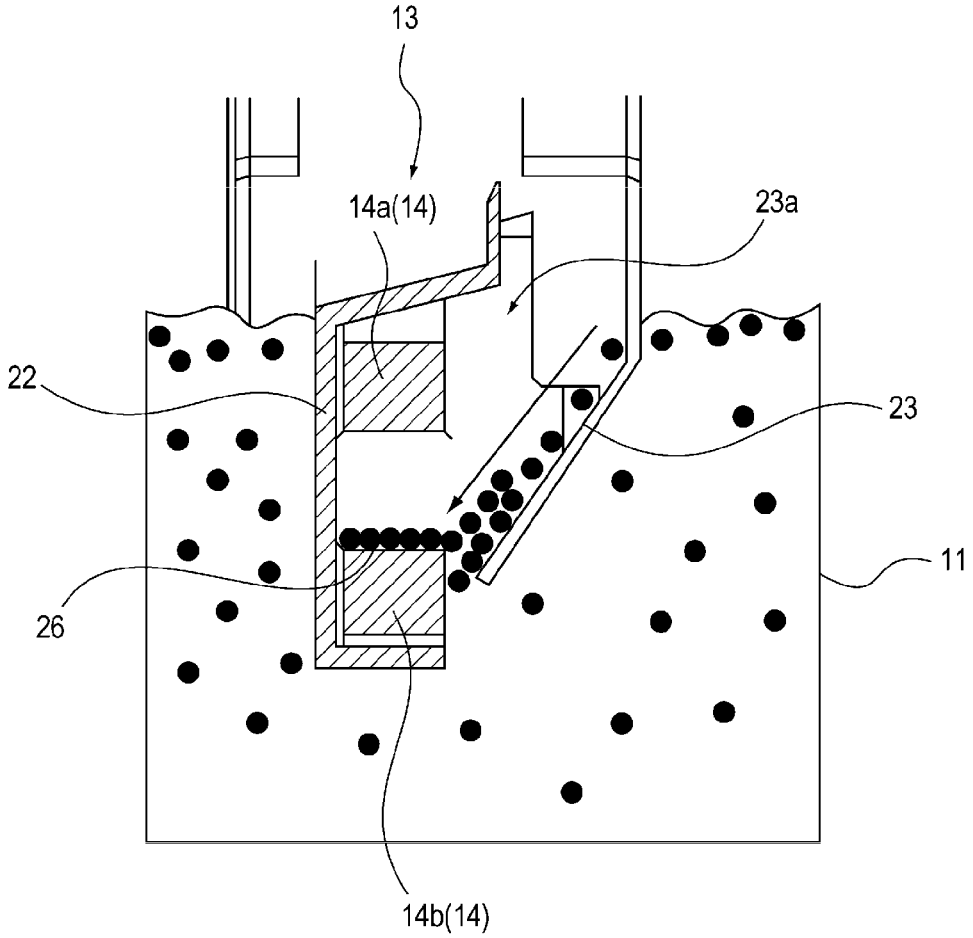
FIG. 9 is a sectional view of the prism unit illustrating a state where the toner is introduced and reaches a detecting region surface.

Moreover, in this embodiment, the light path K between the first prism 14*a* and the second prism 14*b* is set along the substantially vertical direction (see FIG. 5). In these configurations, the light transmits the detecting region 20 when the toner T does not exist in the accommodating container 11. When the toner T is introduced to the interior of the accommodating container 11, as illustrated in FIG. 9, a thin layer of the toner T is formed on the detecting region surface 26 of the top face of the second prism 14*b*, this layer of the toner T certainly closes the light path K, and thus it is detected that the toner T has reached a predetermined amount.

On the other hand, it is assumed that the prism 14 is disposed such that the light path K inside the detecting region 20 is formed along a substantially horizontal direction. This, for example, is equivalent to the configuration in which the prism 14 is rotated 90 degrees in a counterclockwise direction as illustrated in FIG. 7. That is, it is equivalent to a configuration in which the first prism 14*a* and the second prism 14*b* of the prism 14 are arranged in the horizontal direction. In these configurations, when the toner T is not accumulated over an entire region of the detecting region 20 between the first prism 14*a* and the second prism 14*b*, the light path is not closed. For this reason, when the bridge arises in the accumulating portion, a gap occurs in a part, the light path is generated, and thus there is a concern about an erroneous detection.

Based on these, even though the amount of accumulated toner T is small, there is an advantage that the toner T is better detected when the light path K of the detecting region 20 is formed along the substantially vertical direction than when the light path K of the detecting region 20 is formed along the substantially horizontal direction.

Moreover, in this embodiment, the introducing member 23 is formed in a plate shape and is set larger than the repose angle of the toner T in an angle relative to a horizontal plane. When the introducing member 23 is set to such an inclined face, since the toner T is difficult to deposit on the introducing member 23, the toner T is reliably introduced into the detecting region 20.

Further, in this embodiment, a vertically upper side of the introducing member 23 is open (become an open space) in the interior of the accommodating container 11. According to this configuration, the toner T to be deposited is bridged and thus a phenomenon which is not able to invade to the point of the introducing member 23 is suppressed.

Figure 8:
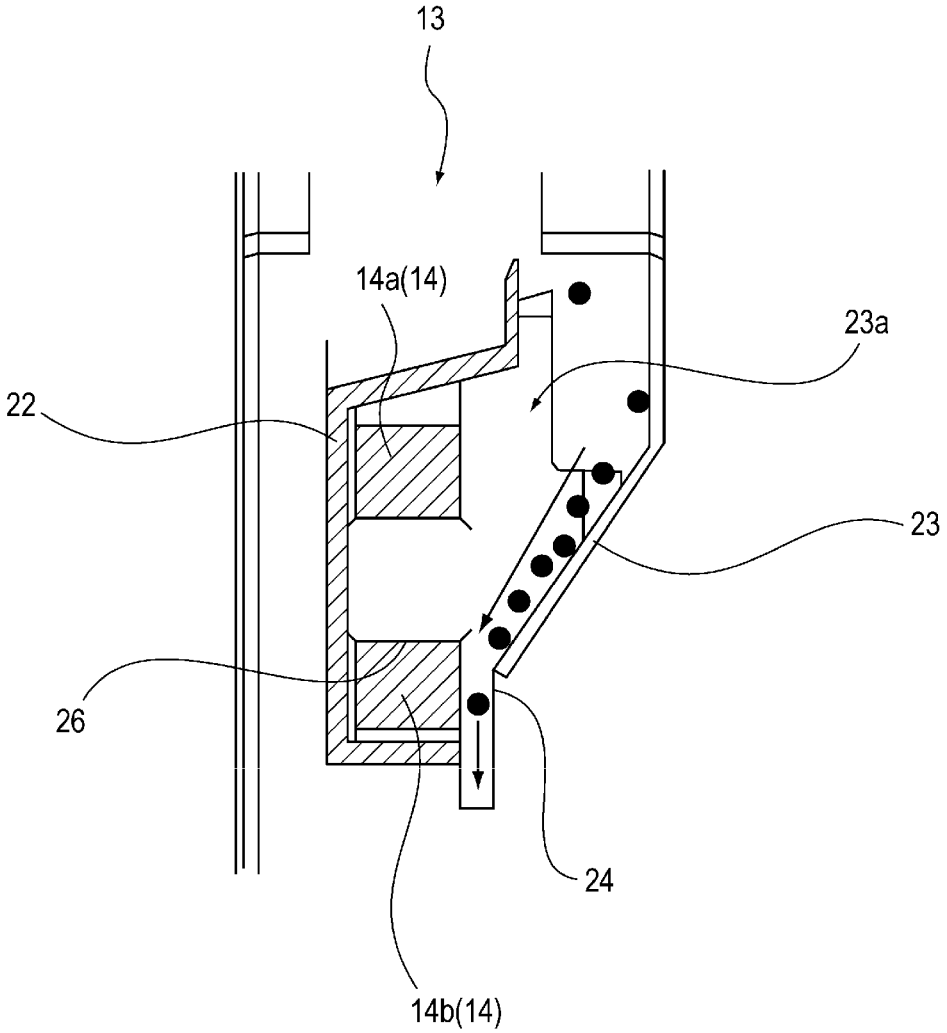
FIG. 8 is a sectional view of the prism unit illustrating a state at the time when toner is introduced.

FIG. 8 is a sectional view of the prism unit 13 illustrating a state at the time when the toner T is introduced. Moreover, this embodiment has described based on a system in which the introducing member 23 is provided at the opposite side to the falling inlet 12 of the accommodating container 11, but may not be limited to this configuration. That is, as illustrated in FIG. 7, a gap 24 is formed between the introducing member 23 and the detecting region surface 26 which is formed in the second prism 14*b*. In the case of this configuration, even when the toner T is introduced into the introducing member 23, the toner T may fall down the covering member 22 without invading into the detecting region surface 26. Moreover, a lower end of the gap 24 is adapted to a dead-end in FIG. 7, but an escaping hole (discharge outlet) for escaping the toner T is practically formed at the lower end of the gap 24. Due to the above-described reasons, there is no need to dispose the introducing member 23 on the opposite side of the falling inlet 12.

FIG. 9 is a sectional view of the prism unit 13 illustrating a state where the toner is introduced and reaches the detecting region surface 26. As illustrated in FIG. 9, the toner T is accumulated between the second prism 14*b* and the introducing member 23 and reaches the surface of the detecting region surface 26.

Figure 10A:
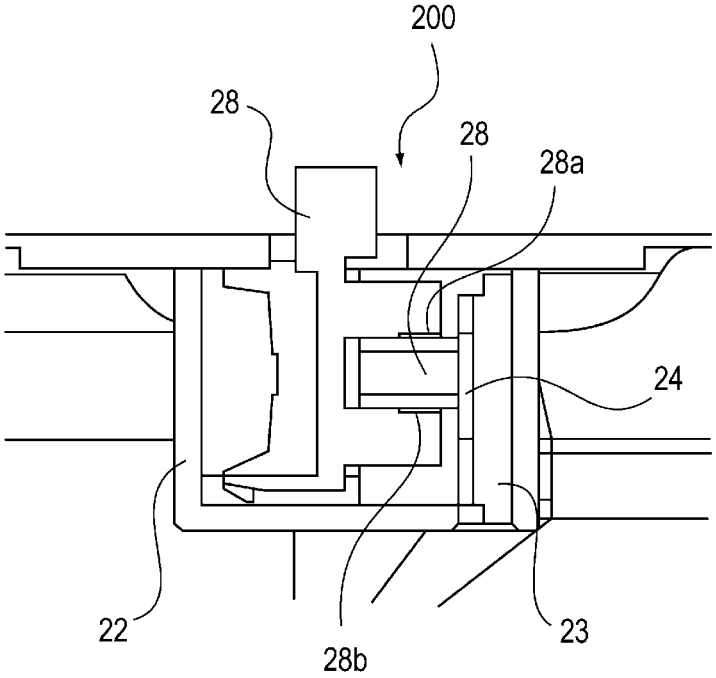
FIGS. 10A and 10B are structure diagrams illustrating a structure of an accommodating container according to a modified example of the embodiment.
Figure 10B:
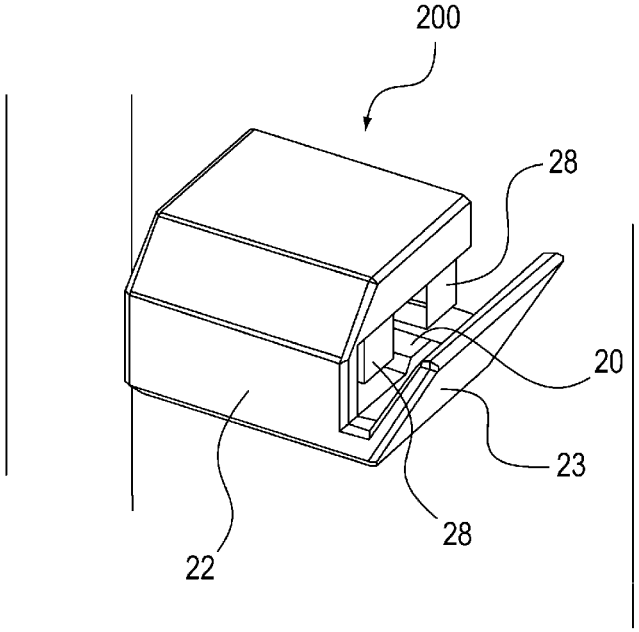

FIG. 10A is a sectional view illustrating a structure of a powder amount detecting system 200 according to a modified example of the embodiment, and FIG. 10B is a perspective view of the powder amount detecting system 200. Also, reference numerals used in FIGS. 10A and 10B having the same function as in the previous embodiment are designated by the same numerals and the description thereof will not be presented. In the above-described embodiment, the prism 14 is installed inside the accommodating container 11 and the reflective sensor 17 is disposed at the apparatus body 60A side. However, it may not be limited to the configuration in which the above-described accommodating container 11 includes the light emitting element 17*a* and the light receiving element 17*b* and the light emitted from the light emitting element 17*a* is reflected by the reflective member which is separately provided. That is, as illustrated in FIGS. 10A and 10B, even in the configuration provided with an optical sensor such as a photo interrupter 28 for directly self-receiving the light at the light receiving portion, while installation property or running cost deteriorates, the same effects may be obtained. Further, in this configuration, the photo interrupter 28 serving as "detecting unit" is made up of a light emitting element 28*a* and a light receiving element 28*b* facing each other and the detecting region 20 is defined between the light emitting element 28*a* and the light receiving element 28*b*.

In addition, the powder amount detecting system 200 is installed inside the accommodating container 11, even in this configuration, but it is configured such that the introducing member 23 is disposed at a side far from the falling inlet 12.

According to the invention, it may reliably detect the amount of powders within the accommodating container without erroneous detection compared to the related art.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-154360, filed Jul. 10, 2012, which is hereby incorporated by reference herein in its entirety.

What is claimed is:

1. A developer accommodating container detachably mountable to an image forming apparatus, the developer accommodating container comprising:

an inlet that receives developer; and an optical unit that is located lower than the inlet in a vertical direction in the accommodating container when the accommodating container is mounted on the image forming apparatus, the optical unit leading light that is emitted from a light emitting element to a light receiving element, wherein the optical unit comprises:

a first optical portion that is located in the optical unit and forms part of a light path to detect the developer;

a second optical portion that is located facing the first optical portion and forms part of the light path;

a detecting region that is located between the first optical portion and the second optical portion and in which developer led to the optical unit accumulates;

a cover portion that covers the first optical portion, the second optical portion, and the detecting region, the cover portion having an opening that is able to introduce the developer into the optical unit to detect the developer, wherein the opening is located at a position that (i) does not overlap in a vertical direction against the inlet and the detecting region, and (ii) is higher than the detecting region in the vertical direction; and a discharge portion that is provided on the cover and is able to discharge the developer that is introduced through the opening, wherein the discharge portion is located below the detecting region.

2. The developer accommodating container according to claim 1, wherein the optical unit has a guide portion that guides developer received from the opening to a side where the detecting region is located.

3. The developer accommodating container according to claim 2, wherein a top face of the cover portion is provided with an inclined portion that is downwardly-inclined toward the side of the inlet from the side of the opening.

4. The developer accommodating container according to claim 2, wherein a top face of the cover portion includes a rib that upwardly extends around the opening.

5. The developer accommodating container according to claim 4, wherein a height of the rib of the side of the inlet is lower than that of an other side of the rib.

6. The developer accommodating container according to claim 2, wherein an angle of inclination for a horizontal plane of the guide portion is greater than an angle of a repose angle of powders.

7. The developer accommodating container according to claim 2, wherein the discharge portion is located between the guide portion and the detecting region, and a downstream edge of the guide portion in the guide direction is located below the detecting region.

8. The developer accommodating container according to claim 1, wherein the first optical portion and the second optical portion are arranged in the vertical direction, and the light path between the first optical portion and the second optical portion is set to be formed along a substantially vertical direction.

9. An image forming apparatus comprising:

an image forming portion that forms an image; and the developer accommodating container according to claim 1.

10. The developer accommodating container according to claim 1, wherein, when seen from a vertical direction, the opening is provided at a position that is further from the detecting region than the inlet.

11. An optical unit that leads light that is emitted from a light emitting element for a light receiving element, the optical unit comprising:

a first optical portion that is located in the optical unit and forms part of a light path to detect the developer;

a second optical portion that is located facing the first optical portion and forms part of the light path;

a detecting region that is located between the first optical portion and the second optical portion and in which developer led to the optical unit accumulates;

a cover portion that has an opening for introducing the developer into the optical unit to detect the developer, the cover portion covering the first optical portion, the second optical portion, and the detecting region;

a guide portion that guides the developer that is received from the opening to the detecting region; and a discharge portion that (i) is provided on the cover, (ii) is located between the guide portion and the detecting region, and (iii) is able to discharge the developer that is introduced by the guide portion.

12. A developer accommodating container detachably mountable to an image forming apparatus, the developer accommodating container comprising:

an inlet that receives developer;

an optical unit that is located lower than the inlet in a vertical direction in the accommodating container when the accommodating container is mounted on the image forming apparatus, the optical unit leading light that is emitted from a light emitting element to a light receiving element;

wherein the optical unit comprises:

a first optical portion that is located in the optical unit and forms part of a light path to detect the developer;

a second optical portion that is located as facing the first optical portion and forms part of the light path;

a detecting region that is located between the first optical portion and the second optical portion and in which developer led to the optical unit is accumulated;

a cover portion that covers the first optical portion, the second optical portion, and the detecting region, the cover portion having a first opening that is able to introduce the developer into the optical unit to detect the developer, wherein the first opening is located at a position that (i) does not overlap in the vertical direction against the inlet and the detecting region, and (ii) is higher than the detect portion detecting region in the vertical direction when the accommodating container is mounted on the image forming apparatus;

a guide portion that guides the developer that is received from the first opening to a side where the detecting region is located; and a second opening that is provided between the detecting region and the guide portion in a horizontal direction to lead the developer from the guide portion when the accommodating container is mounted on the image forming apparatus.

13. The developer accommodating container according to claim 12, wherein a top face of the cover portion is provided with an inclined portion that is downwardly-inclined toward the side of the inlet from the side of the first opening.

14. The developer accommodating container according to claim 12, wherein a top face of the cover portion includes a rib that upwardly extends around the first opening.

15. The developer accommodating container according to claim 14, wherein a height of the rib of the side of the inlet is lower than that of an other side of the rib.

16. The developer accommodating container according to claim 12, wherein the first optical portion and the second optical portion are arranged in the vertical direction, and a light path between the first optical portion and the second optical portion is set to be formed along a substantially vertical direction.

17. An image forming apparatus comprising:

an image forming portion that forms an image;

and the developer accommodating container according to claim 12.

18. The developer accommodating container according to claim 12, wherein an angle of inclination for a horizontal plane of the guide portion is bigger than an angle of a repose angle of powders.

19. The developer accommodating container according to claim 12, wherein, when seen from a vertical direction, the first opening is provided at a position that is further from the detecting region than the inlet.

20. The developer accommodating container according to claim 12, wherein the second opening is located between the guide portion and the detecting region, and a downstream edge of the guide portion in the guide direction is located below the detecting region.

* * * * *